US008047016B2

(12) United States Patent
Jeon et al.

(10) Patent No.: US 8,047,016 B2
(45) Date of Patent: Nov. 1, 2011

(54) INDOOR UNIT OF AIR CONDITIONER

(75) Inventors: Jong Ki Jeon, Suwon-si (KR); Jai Kwon Lee, Suwon-si (KR); Do Yeon Kim, Anyang-si (KR); Dae Sung Lee, Suwon-si (KR); Jei Min Choi, Suwon-si (KR); Jong Won Lee, Seongnam-si (KR); Kang Min Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 531 days.

(21) Appl. No.: 12/232,609

(22) Filed: Sep. 19, 2008

(65) Prior Publication Data

US 2009/0199583 A1 Aug. 13, 2009

(30) Foreign Application Priority Data

Feb. 12, 2008 (KR) ..... 10-2008-0012582

(51) Int. Cl.
*F25D 17/06* (2006.01)

(52) U.S. Cl. ..... 62/419; 62/426

(58) Field of Classification Search ..... 62/426, 62/259.1, 298, 326, 408, 314, 414, 419; 454/143, 454/152, 155, 316
See application file for complete search history.

(56) References Cited

U.S. PATENT DOCUMENTS

| | | | | |
|---|---|---|---|---|
| 3,590,594 | A * | 7/1971 | Arend | 62/117 |
| 4,759,190 | A * | 7/1988 | Trachtenberg et al. | 62/3.62 |
| 4,823,554 | A * | 4/1989 | Trachtenberg et al. | 62/3.3 |
| 5,338,252 | A * | 8/1994 | Bowler et al. | 454/155 |
| 5,626,517 | A * | 5/1997 | Kil | 454/315 |
| 5,741,179 | A * | 4/1998 | Sun et al. | 454/155 |
| 5,746,651 | A * | 5/1998 | Arajs et al. | 454/154 |
| 5,947,813 | A * | 9/1999 | Chow et al. | 454/155 |
| 6,494,780 | B1 * | 12/2002 | Norbury, Jr. | 454/319 |
| 7,051,539 | B2 * | 5/2006 | Junge et al. | 62/90 |
| 2002/0022450 | A1 * | 2/2002 | Berger | 454/290 |
| 2004/0092224 | A1 * | 5/2004 | Gehring et al. | 454/155 |
| 2004/0144128 | A1 * | 7/2004 | Junge et al. | 62/441 |
| 2006/0005568 | A1 * | 1/2006 | Sim et al. | 62/419 |
| 2006/0248915 | A1 * | 11/2006 | Lee | 62/407 |
| 2007/0289321 | A1 * | 12/2007 | Kang et al. | 62/186 |
| 2008/0104977 | A1 * | 5/2008 | Coulter et al. | 62/132 |
| 2008/0134708 | A1 * | 6/2008 | Lee et al. | 62/340 |
| 2008/0203041 | A1 * | 8/2008 | Lim et al. | 211/119.003 |

FOREIGN PATENT DOCUMENTS

| | | |
|---|---|---|
| JP | 56-061254 | 5/1981 |

* cited by examiner

*Primary Examiner* — Mohammad Ali
(74) *Attorney, Agent, or Firm* — Staas & Halsey LLP

(57) ABSTRACT

Disclosed is an indoor unit of an air conditioner, in which discharge units respectively provided on upper and lower portions of the indoor unit have an improved discharge structure such that the discharge units are interchangeable, to increase cooling efficiency regardless of installation position of the indoor unit. The indoor unit includes a cabinet; a first discharge unit being detachably provided on the cabinet and configured to discharge air in a forward direction; and a second discharge unit separated from the first discharge unit, being detachably provided on the cabinet and configured to discharge air in the oblique direction, the first discharge unit and the second discharge unit being interchangeable according to a height of a position at which the cabinet is installed. The indoor unit of the air conditioner sets the optimum direction of discharged air, thus increasing the cooling efficiency of an indoor space.

7 Claims, 5 Drawing Sheets

INDOOR UNIT OF AIR CONDITIONER

CROSS-REFERENCE TO RELATED APPLICATIONS

This application claims the benefit of Korean Patent Application No. 2008-0012582, filed Feb. 12, 2008, in the Korean Intellectual Property Office, the disclosure of which is incorporated herein by reference.

BACKGROUND

1. Field

The present invention relates to an indoor unit of an air conditioner, and more particularly, to an indoor unit of an air conditioner in which discharge units respectively provided on upper and lower portions of the indoor unit have an improved discharge structure such that the discharge units are interchangeable.

2. Description of the Related Art

In general, air conditioners are apparatuses that regulate the temperature, the humidity, the distribution of an air current, etc., suitable for human living using a refrigerating cycle and remove dust from air. The refrigerating cycle is composed of a compressor, a condenser, an evaporator, a blower fan, etc.

Air conditioners are divided into integration type air conditioners, in which a refrigerating cycle is installed in a single cabinet and the cabinet is installed on a window, and split type air conditioners, in which a refrigerating cycle is divided into two cabinets and the cabinets are respectively installed inside and outside a room. Split type air conditioners are divided into a wall-mounted type air conditioner, a standing type air conditioner, a ceiling-mounted type air conditioner, a ceiling-buried type air conditioner, etc., according to installation methods. Particularly, an air conditioner, which can be installed by various methods according to user's requirement, i.e., used as a wall-mounted type air conditioner or a standing type air conditioner, is referred to as a convertible type air conditioner.

In order to increase the cooling efficiency of a convertible type air conditioner, the direction of air discharged from an indoor unit of the convertible type air conditioner must be varied according to installation positions. For example, in the case that the indoor unit of the convertible type air conditioner stands on the floor, a discharge hole provided on an upper portion of the indoor unit of the air conditioner discharges air upwardly and a discharge hole provided on a lower portion of the indoor unit of the air conditioner discharges air forwardly so as to rapidly cool an indoor space. On the other hand, in the case that the indoor unit of the convertible type air conditioner is mounted on a wall, the discharge hole provided on the upper portion of the indoor unit of the air conditioner discharges air forwardly and the discharge hole provided on the lower portion of the indoor unit of the air conditioner discharges air downwardly so as to rapidly cool an indoor space.

However, convertible type air conditioners are put on the market under the condition that air discharging directions of upper and lower discharge holes of an indoor unit are already fixed. Thereby, in the case that an installation position is changed by the user's need, the cooling efficiency of an indoor space is lowered and abnormal noise is generated. For example, a wall-mounted type air conditioner is designed such that a discharge hole provided on the upper portion of an indoor unit discharges air forwardly and a discharge hole provided on the lower portion of the indoor unit discharges air downwardly. Thus, even in the case that the indoor unit of the wall-mounted type air conditioner stands on the floor according to a user's need, the discharge hole provided on the upper portion of the indoor unit discharges air forwardly and the discharge hole provided on the lower portion of the indoor unit discharges air downwardly. In this case, it takes a long time to cool down to the upper region of the indoor space, and thus power consumption is increased. Further, the air discharged from the lower discharge hole generates abnormal noise due to collision with the floor.

On the other hand, a standing type air conditioner is designed such that a discharge hole provided on the upper portion of an indoor unit discharges air upwardly and a discharge hole provided on the lower portion of the indoor unit discharges air forwardly. However, in the case that the indoor unit of the standing type air conditioner is mounted on a wall according to the user's need, the air discharged from the upper discharge hole generates abnormal noise due to collision with the ceiling.

SUMMARY

Therefore, one aspect of the embodiment is to provide an indoor unit of an air conditioner in which discharge units respectively provided upper and lower portions of the indoor unit have an improved discharge structure such that the discharge units are interchangeable, so as to increase cooling efficiency regardless of installation position of the indoor unit.

Additional aspects and/or advantages will be set forth in part in the description which follows and, in part, will be apparent from the description, or may be learned by practice of the invention.

The foregoing and/or other aspects are achieved by providing an indoor unit of an air conditioner, including: a cabinet; a first discharge unit being detachably provided on the cabinet and configured to discharge air in a forward direction; and a second discharge unit separated from the first discharge unit, and being detachably provided on the cabinet and configured to discharge air in an oblique direction, the first discharge unit and the second discharge unit being interchangeable according to a height of a position at which the cabinet is installed.

The cabinet may include an upper mounting part provided on an upper portion of the cabinet, on which one of the first discharge unit and the second discharge unit is mounted; and a lower mounting part provided on a lower portion of the cabinet, on which the other of the first discharge unit and the second discharge unit is mounted.

The first discharge unit may be installed on the upper mounting part and the second discharge unit may be installed on the lower mounting part when the cabinet is installed at a relatively high position.

Further, the first discharge unit may be installed on the lower mounting part and the second discharge unit may be installed on the upper mounting part when the cabinet is installed at a relatively low position.

The first discharge unit may have a rectangular cross-section to discharge air in the forward direction, and the second discharge unit may have a fan-shaped cross-section to discharge air in the oblique direction.

The upper mounting part and the lower mounting part may be symmetrical with each other such that the first discharge unit and the second discharge unit are interchangeable on the upper mounting part or the lower mounting part.

Any one of the first and second discharge units may be selectively installed on the upper mounting part, and the other one of the first and second discharge units may be selectively installed on the lower mounting part.

The first discharge unit or the second discharge unit may be attached to the upper mounting part or the lower mounting part by screws or other connecting materials or structure.

First connecting parts may be provided on both side surfaces of the first discharge unit, and second connecting parts may be provided on both side surfaces of the second discharge unit, the upper mounting part including upper connecting parts connected to one of the first connecting parts and the second connecting parts, and the lower mounting part including lower connecting parts connected to the other of the first connecting parts and the second connecting parts.

The first discharge unit and the second discharge unit may have a same distance in a lengthwise direction, and the upper mounting part and the lower mounting part may have a same distance in a lengthwise direction.

Further, the first discharge unit and the second discharge unit may have a same distance in a widthwise direction, and the upper mounting part and the lower mounting part may have a same distance in a widthwise direction.

The foregoing and/or other aspects are achieved by providing an indoor unit of an air conditioner, including: a cabinet having an upper portion and a lower portion; a first discharge unit being detachably provided on the upper portion of the cabinet; and a second discharge unit separated from the first discharge unit and detachably provided on the lower portion of the cabinet, the first discharge unit and the second discharge unit discharging air in different directions according to a height of a position at which the cabinet is installed.

Any one of the first and second discharge units may discharge air in a forward direction, and the other one of the first and second discharge units may discharge air in an oblique direction.

The first discharge unit may discharge air in the forward direction when the cabinet is installed at a relatively high position and may discharge air in the oblique direction when the cabinet is installed at a relatively low position.

The cabinet may include an upper mounting part on which the first discharge unit is mounted, the first discharge unit being attached to the upper mounting part by screws.

The second discharge unit may discharge air in the oblique direction when the cabinet is installed at a relatively high position and may discharge air in the forward direction when the cabinet is installed at a relatively low position.

The cabinet may include a lower mounting part on which the second discharge unit is mounted, the second discharge unit being attached to the lower mounting part by screws.

The foregoing and/or other aspects are achieved by providing an indoor unit of an air conditioner, including: a cabinet having an upper portion and a lower portion; a first discharge unit being detachably provided on one of the upper portion and the lower portion of the cabinet; and a second discharge unit being detachably provided on the other of the upper portion and the lower portion of the cabinet, wherein the first discharge unit and the second discharge unit discharge air in different directions.

The first discharge unit may discharge air in a forward direction and the second discharge unit may discharge air in an oblique direction.

The first discharge unit may be mounted at the upper portion of the cabinet and the second discharge unit may be mounted at the lower portion of the cabinet when the cabinet is installed at a relatively high position with respect to a ground surface.

The second discharge unit may discharge air obliquely in a downward direction with respect to the position of the cabinet.

The second discharge unit may be mounted at the upper portion of the cabinet and the first discharge unit may be mounted at the lower portion of the cabinet when the cabinet is installed at a relatively low position with respect to a ground surface.

The second discharge unit may discharge air obliquely in an upper direction with respect to the position of the cabinet.

BRIEF DESCRIPTION OF THE DRAWINGS

These and/or other aspects and advantages will become apparent and more readily appreciated from the following description of the embodiment, taken in conjunction with the accompanying drawings in which.

DETAILED DESCRIPTION OF EMBODIMENT

Figure 1:
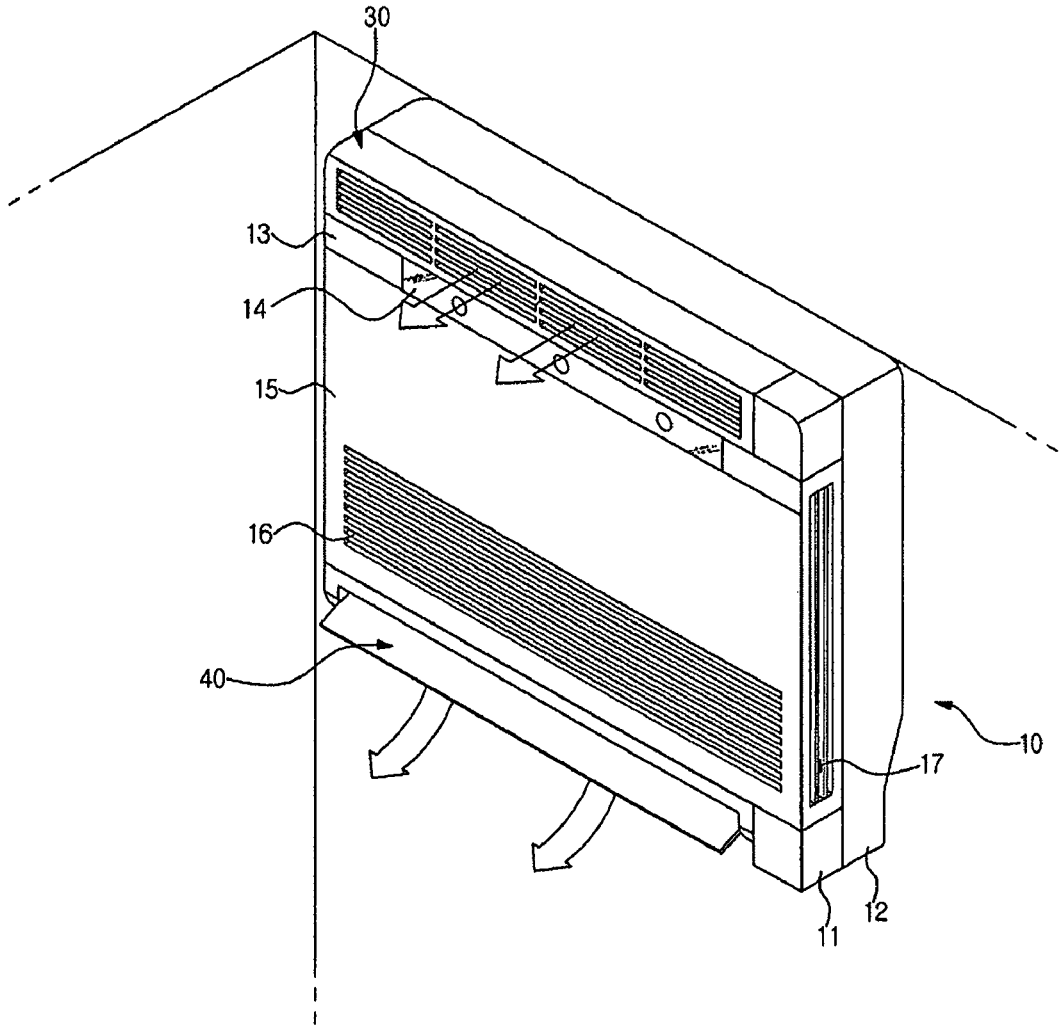
FIG. 1 is a perspective view illustrating an external appearance of an indoor unit of a wall-mounted type air conditioner in accordance with the present embodiment.

Reference will now be made in detail to the embodiment, an example of which is illustrated in the accompanying drawings, wherein like reference numerals refer to like elements throughout. The embodiment is described below to explain the present invention by referring to the annexed drawings.

FIG. 1 is a perspective view illustrating an external appearance of an indoor unit of a wall-mounted type air conditioner in accordance with the present embodiment.

As shown in FIG. 1, the indoor unit of the wall-mounted type air conditioner of the present embodiment includes a cabinet 10 formed by connecting a front frame 11 and a rear frame 12. A display unit 14 for to display whether or not the air conditioner is operated or the operating state of the air conditioner is provided on a control panel 13 formed on a front surface of the cabinet 10. Buttons are installed on the display unit 14, and thus a user can control the air conditioner by hand, or input a signal into the display unit 14 using a remote controller and thus automatically control the air conditioner.

A front suction part 16 to suck air is formed through a lower portion of the front surface of a front panel 15 formed on the front surface of the cabinet 10, and side suction parts 17 to suck air are respectively formed through both side surfaces of the front panel 15. A first discharge unit 30 to discharge air is formed on an upper portion of the front surface of the cabinet 10, and a second discharge unit 40 to discharge air is formed on the lower portion of the front surface of the cabinet 10. Thus, indoor air is sucked into the indoor unit through the front and side surfaces of the cabinet 10, and air having exchanged heat with the inside of the cabinet 10 is discharged to the inside of a room through the upper and lower portions of the front surface of the cabinet 10. FIG. 1 illustrates the cabinet 10, which is mounted on a wall at a relatively high position. Here, in order to increase the cooling efficiency of the room, the first discharge unit 30 provided on the upper portion of the cabinet 10 discharges air in a forward direction, and the second discharge unit 40 provided on the lower portion of the cabinet 10 discharges air in an oblique direction, i.e., a middle direction between the forward direction and a downward direction.

Figure 2:
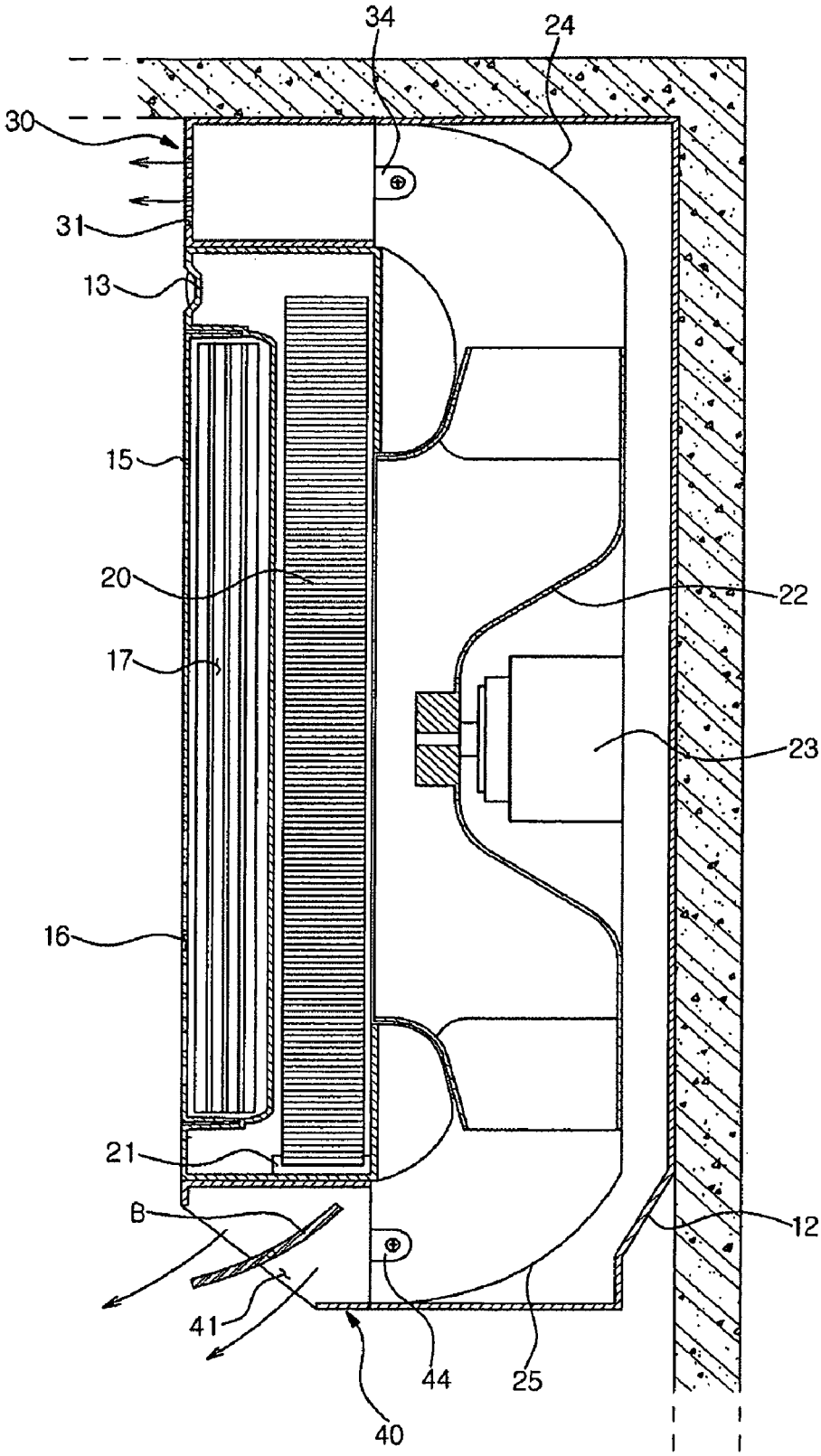
FIG. 2 is a cross-sectional view illustrating an internal constitution of the indoor unit of the wall-mounted type air conditioner in accordance with the present embodiment.

FIG. 2 is a cross-sectional view illustrating an internal constitution of the indoor unit of the wall-mounted type air conditioner in accordance with the present embodiment.

As shown in FIG. 2, in the indoor unit of the wall-mounted type air conditioner of the present embodiment, a centrifugal fan 22 and a driving motor 23 to drive the centrifugal fan 22 are installed at a center of the front frame 12. Since a heat exchanger 20 is installed in front of the centrifugal fan 22, the indoor air sucked through the front suction part 16 and the side suction parts 17 passes through the heat exchanger 20 such that the indoor air can exchange heat with a refrigerant. Here, moisture contained in the sucked air is condensed into water by the heat exchanger 20. A drain 21 to collect the condensed water is installed under the heat exchanger 20.

The air passed through the heat exchanger 20 is discharged in upward and downward directions by the centrifugal fan 22. The air discharged in the upward and downward directions by the centrifugal fan 22 is guided by upper and lower guide parts 24 and 25 provided on the upper and lower portions of the rear frame 12 to be discharged to the front portion of the cabinet 10. That is, the air blown upwardly by the centrifugal fan 22 is guided to the first discharge unit 30 by the upper guide part 24, and the air blown downwardly by the centrifugal fan 22 is guided to the second discharge unit 40 by the lower guide part 25.

The air guided by the upper guide part 24 is discharged in the forward direction through the first discharge unit 30, and the air guided by the lower guide part 25 is discharged in the oblique direction, i.e., the middle direction between the forward direction and the downward direction, through the second discharge unit 40. The guidance of the air occurs due to the shapes of the first discharge unit 30 and the second discharge unit 40, in which first discharge holes 31 provided in the first discharge unit 30 face forwardly and a second discharge hole 41 provided in the second discharge unit 40 faces obliquely.

Figure 3:
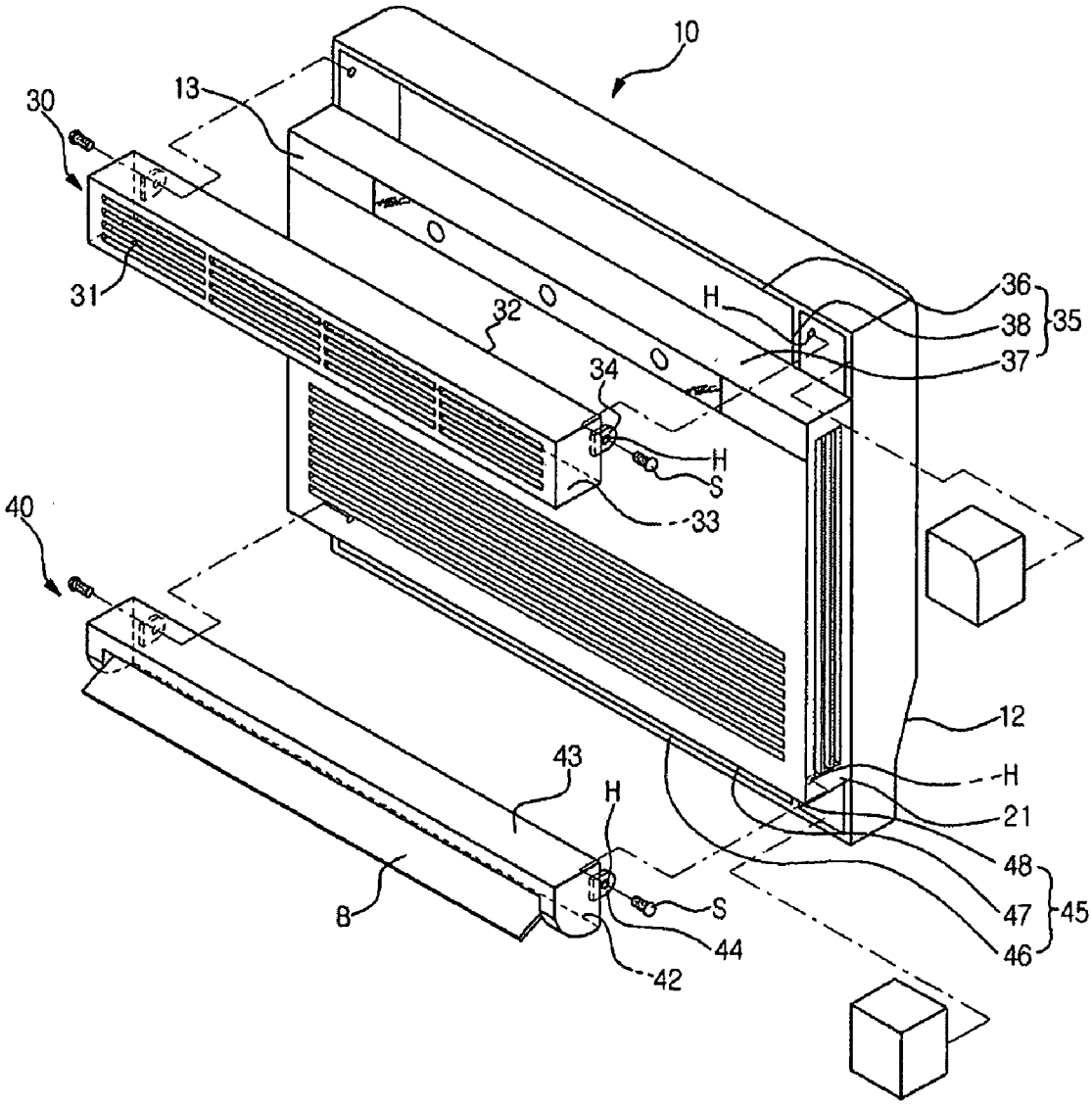
FIG. 3 is an exploded perspective view of the indoor unit of the wall-mounted type air conditioner in accordance with the present embodiment.

FIG. 3 is an exploded perspective view of the indoor unit of the wall-mounted type air conditioner in accordance with the present embodiment.

As shown in FIGS. 2 and 3, in the indoor unit of the wall-mounted type air conditioner, the first discharge unit 30 is detachably formed on the upper portion of the front surface of the cabinet 10, and the second discharge unit 40 is detachably formed on the lower portion of the front surface of the cabinet 10.

An upper mounting part 35, on which the first discharge unit 30 is mounted, is provided on the upper portion of the cabinet 10. The upper mounting part 35 includes an upper end 36 of the rear frame 12 by which an upper end 32 of the first discharge unit 30 is supported, an upper surface 37 of the control panel 13 by which a lower surface 33 of the first discharge unit 30 is supported, and upper connecting parts 38 of the rear frame 12 by which the side surfaces of the first discharge unit 30 are supported. The first discharge unit 30 and the upper mounting part 35 are connected by screws. That is, first connecting parts 34, each having a screw hole (H) formed therethrough, are respectively protruded from both side surfaces of the first discharge unit 30, and a screw hole (H) is formed through each of the upper connecting parts 38 of the upper mounting part 35 at a position corresponding to the first connecting part 34. Thus, after the first discharge unit 30 is mounted on the upper mounting part 35, the first discharge unit 30 is connected to the upper mounting part 35 by screws (S). On the other hand, when the screws (S) are loosened, the first discharge unit 30 is easily separated from the upper mounting part 35.

A lower mounting part 45, on which the second discharge unit 40 is mounted, is provided on the lower portion of the cabinet 10. The lower mounting part 45 includes a lower end 46 of the rear frame 12 by which a lower end 42 of the second discharge unit 40 is supported, a lower surface 47 of the drain 21 by which an upper surface 43 of the second discharge unit 40 is supported, and lower connecting parts 48 of the rear frame 12 by which the side surfaces of the second discharge unit 40 are supported. The second discharge unit 40 and the lower mounting part 45 are connected by screws. That is, second connecting parts 44 each having a screw hole (H) formed therethrough are respectively protruded from both side surfaces of the second discharge unit 40, and a screw hole (H) is formed through each of the lower connecting parts 48 of the lower mounting part 45 at a position corresponding to the second connecting part 44. Thus, after the second discharge unit 40 is mounted on the lower mounting part 45, the second discharge unit 40 is connected to the lower mounting part 45 by screws (S). On the other hand, when the screws (S) are loosened, the second discharge unit 40 is easily separated from the lower mounting part 45.

The first discharge unit 30 can be detachably attached to the upper mounting part 35 or the lower mounting part 45 selectively, and the second discharge unit 40 can be detachably attached to the upper mounting part 35 or the lower mounting part 45 selectively. For this reason, the first discharge unit 30 and the second discharge unit 40 have the same length and width, the upper mounting part 35 and the lower mounting part 45 have the same length and width, and the rear frame 12 has a symmetrical shape in which the upper and lower portions of the rear frame 12 is symmetrical with respect to the horizontal center line. Thereby, the first discharge unit 30 and the second discharge unit 40 can be installed interchangeably. That is, the first discharge unit 30 separated from the upper mounting part 35 can be connected to the lower mounting part 45, and the second discharge unit 40 separated from the lower mounting part 45 can be connected to the upper mounting part 35.

Figure 4:
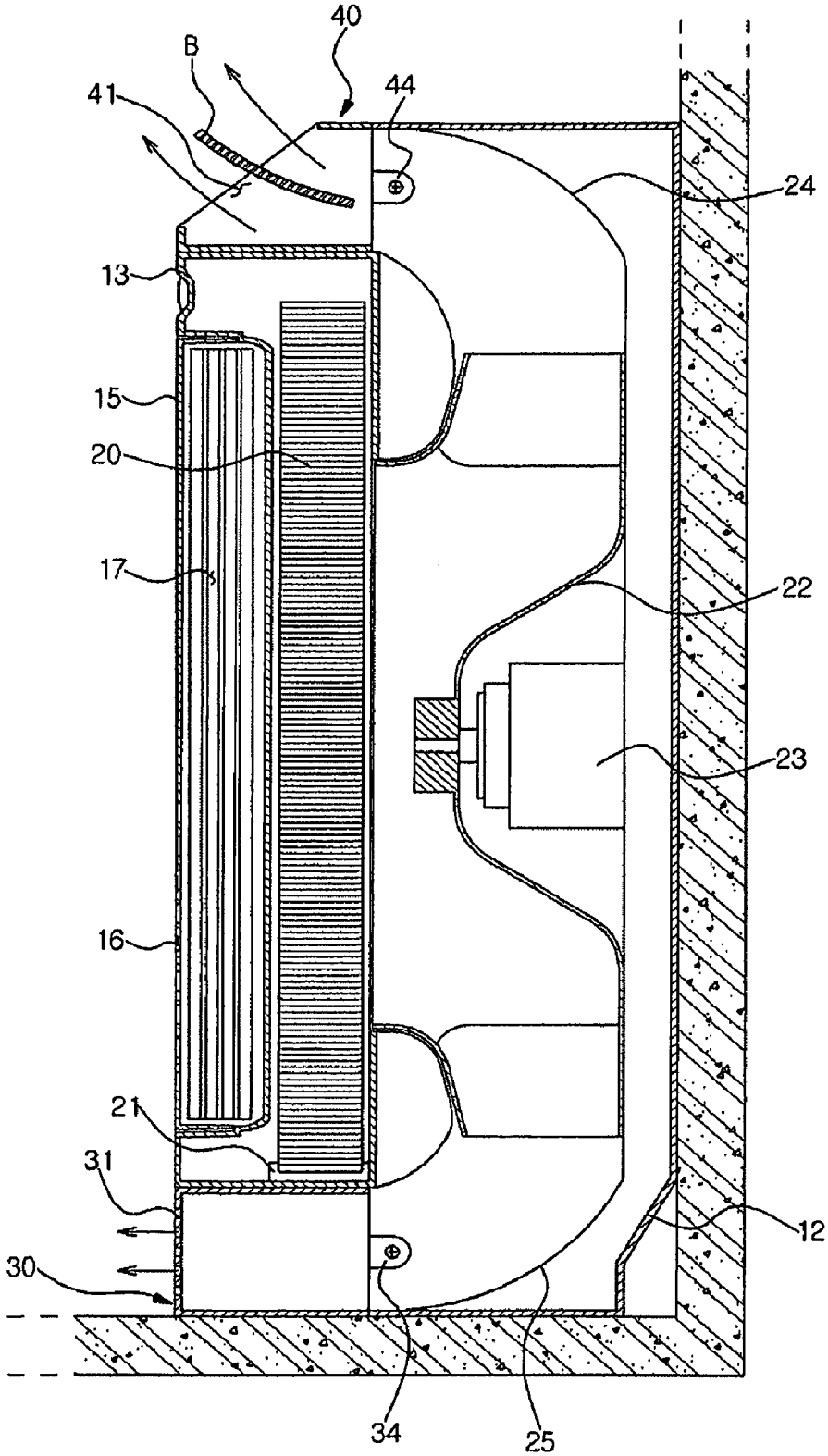
FIG. 4 is a cross-sectional view of an indoor unit of a standing type air conditioner in accordance with the present embodiment.
Figure 5:
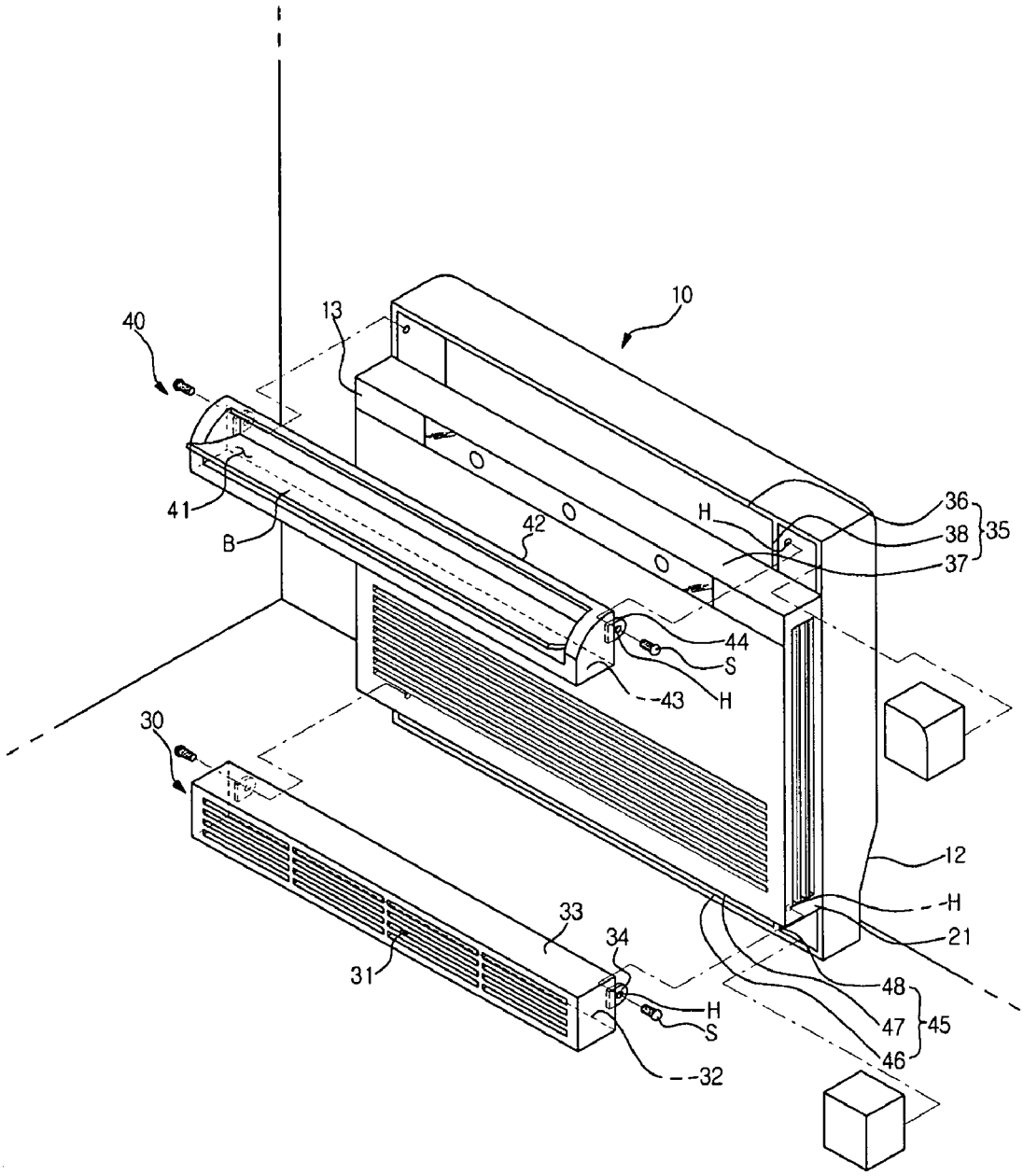
FIG. 5 is an exploded perspective view of the indoor unit of the standing type air conditioner in accordance with the present embodiment.

FIG. 4 is a cross-sectional view of an indoor unit of a standing-type air conditioner in accordance with the present embodiment, and FIG. 5 is an exploded perspective view of the indoor unit of the standing-type air conditioner in accordance with the present embodiment.

As shown in FIGS. 4 and 5, the indoor unit of the standing-type air conditioner of the present embodiment includes a cabinet 10, which stands on the floor, i.e., is installed at a relatively low position. Here, in order to increase the cooling efficiency of an indoor space and reduce unnecessary noise, a second discharge unit 40 provided on the upper portion of the cabinet 10 discharges air in an oblique direction, i.e., a middle direction between the forward direction and the upward direction, and a first discharge unit 30 provided on the lower portion of the cabinet 10 discharges air in a forward direction. A second discharge hole 41 provided in the second discharge unit 40 faces obliquely and thus air guided by an upper guide part 24 is discharged in the oblique direction, and first discharge holes 31 provided in the first discharge unit 30 face forwardly and thus air guided by a lower guide part 25 is discharged in the forward direction.

An upper mounting part 35, on which the second discharge unit 40 is mounted, is provided on the upper portion of the cabinet 10. FIGS. 2 and 3 illustrate the upper mounting part 35 having the first discharge unit 30 mounted thereon, and FIGS. 4 and 5 illustrate the upper mounting part 35 having the second discharge unit 40 mounted thereon. That is, the upper mounting part 35 is designed such that the first discharge unit 30 or the second discharge unit 40 can be selectively mounted on the upper mounting part 35.

Now, the mounting structure of the second discharge unit 40 on the upper mounting part 35 will be described. An upper end 42 of the second discharge unit 40, which is the lower end 42 in FIGS. 2 and 3, is supported by an upper end 36 of the rear frame 12, a lower surface 43 of the second discharge unit 40, which is the upper surface 43 in FIGS. 2 and 3, is supported by an upper surface 37 of the control panel 13, and both side surfaces of the second discharge unit 40 are supported by upper connecting parts 38 of the rear frame 12. Here, second connecting parts 44 each having a screw hole (H) formed therethrough and respectively protruded from both side surfaces of the second discharge unit 40 are connected to the upper connecting parts 38 each having a screw hole (H) by screws (S).

Further, the mounting structure of the first discharge unit 30 on the lower mounting part 45 will be described. A lower end 32 of the first discharge unit 30, which is the upper end 32 in FIGS. 2 and 3, is supported by a lower end 46 of the rear frame 12, an upper surface 33 of the first discharge unit 30, which is the lower surface 33 in FIGS. 2 and 3, is supported by a lower surface 47 of the drain 12, and both side surfaces of the first discharge unit 30 are supported by lower connecting parts 48 of the rear frame 12. Here, first connecting parts 34 each having a screw hole (H) formed therethrough and protruded from both side surfaces of the first discharge unit 30 are connected to the lower connecting parts 48 each having a screw hole (H) by screws (S). While the first discharge unit 30 and the second discharge unit 40 are attached to the upper mounting part 35 or the lower mounting part 45 by screws (S) through the first connecting parts 34 and the second connecting parts 44, the first discharge unit 30 and the second discharge unit 40 may be attached to the upper 35 or lower 45 mounting parts by any type of connecting material or structure such that the first 30 and second 40 discharge units are able to be attached and detached to the upper 35 and lower 45 mounting parts. For example, the connecting material or structure may be hooks and latches, hook and loop fasteners, magnets, etc.

Consequently, as shown in FIGS. 2 to 5, the first discharge unit 30 or the second discharge unit 40 can be installed on the upper mounting part 35 provided on the upper portion of the cabinet 10, and the first discharge unit 30 or the second discharge unit 40 can be installed on the lower mounting part 45 provided on the lower portion of the cabinet 10. That is, as shown in FIGS. 2 and 3, in the case that the indoor unit of the air conditioner is installed at a relatively high position by a user's need, the first discharge unit 30 is installed on the upper mounting part 35 and the second discharge unit 40 is installed on the lower mounting part 45. Thus, air guided upwardly by the upper guide part 24 is discharged in the forward direction through the first discharge holes 31 of the first discharge unit 30, and air guided downwardly by the lower guide part 25 is discharged in the oblique direction through the second discharge hole 41 of the second discharge unit 40.

Further, in the case that the indoor unit of the air conditioner is installed at a relatively low position by a user's need, the first discharge unit 30 is separated from the upper mounting part 35 and the second discharge unit 40 is separated from the lower mounting part 45, as shown in FIGS. 2 and 3. Thereafter, as shown in FIGS. 4 and 5, the first discharge unit 30 is installed on the lower mounting part 45 and the second discharge unit 40 is installed on the upper mounting part 35. Thus, air guided upwardly by the upper guide part 24 is discharged in the oblique direction through the second discharge hole 41 of the second discharge unit 40, and air guided downwardly by the lower guide part 25 is discharged in the forward direction through the first discharge holes 31 of the first discharge unit 30.

Here, a blade (B) may be installed in the first discharge holes 31 of the first discharge unit 30 and the second discharge hole 41 of the second discharge unit 40, thus optimally adjusting the direction of the discharged air.

While the first discharge unit has been identified as discharge unit 30 and the second discharge unit has been identified as discharge unit 40, alternatively the first discharge unit may represent the discharge unit installed at the upper portion of the cabinet 10 and the second discharge unit may represent the discharge unit installed at the lower portion of the cabinet 10.

As apparent from the above description, the present embodiment provides an indoor unit of an air conditioner, which is applied to a wall-mounted type air conditioner and a standing-type air conditioner to set an optimum direction of discharged air, thus increasing the cooling efficiency of an indoor space.

Further, the indoor unit of the air conditioner of the present embodiment prevents the discharged air from unnecessarily colliding with the ceiling or the floor, thus reducing noise.

Further, the indoor unit of the air conditioner of the present embodiment includes upper and lower discharge units, which are respectively provided on the upper and lower portions of the indoor unit such that the upper and lower discharge units are interchangeable, and thus eliminates a necessity for manufacturing a plurality of indoor units having various air discharge directions, thereby drastically reducing manufacturing expenses and increasing customer's satisfaction.

Although an embodiment has been shown and described, it would be appreciated by those skilled in the art that changes may be made in this embodiment without departing from the principles and spirit of the invention, the scope of which is defined in the claims and their equivalents.

What is claimed is:

1. An indoor unit of an air conditioner, comprising:

a cabinet;

a first discharge unit being detachably provided on an upper portion or a lower portion of the cabinet and configured to discharge air in a forward direction;

a second discharge unit separated from the first discharge unit, and being detachably provided on an upper portion or a lower portion of the cabinet and configured to discharge air in an oblique direction;

a centrifugal fan and a driving motor to drive the centrifugal fan mounted in the cabinet; and a heat exchanger installed in front of the centrifugal fan, wherein the first discharge unit is mounted at the upper portion of the cabinet and the second discharge unit is mounted at the lower portion of the cabinet when the cabinet is installed at a relatively high position with respect to a ground surface, and the second discharge unit is mounted at the upper portion of the cabinet and the first discharge unit is mounted at the lower portion of the cabinet when the cabinet is installed at a relatively low position with respect to the ground surface.

2. The indoor unit according to claim 1, wherein the cabinet includes:

an upper mounting part provided on an upper portion of the cabinet, on which one of the first discharge unit and the second discharge unit is mounted; and a lower mounting part provided on a lower portion of the cabinet, on which the other of the first discharge unit and the second discharge unit is mounted.

3. The indoor unit according to claim 2, wherein the first discharge unit has a rectangular cross-section to discharge air in the forward direction, and the second discharge unit has a fan-shaped cross-section to discharge air in the oblique direction.

4. The indoor unit according to claim 3, wherein the upper mounting part and the lower mounting part are symmetrical with each other such that the first discharge unit and the second discharge unit are interchangeable on the upper mounting part or the lower mounting part.

5. The indoor unit according to claim 2, wherein first connecting parts are provided on both side surfaces of the first discharge unit, and second connecting parts are provided on both side surfaces of the second discharge unit, the upper mounting part including upper connecting parts connected to one of the first connecting parts and the second connecting parts, and the lower mounting part including lower connecting parts connected to the other of the first connecting parts and the second connecting parts.

6. The indoor unit according to claim 2, wherein the first discharge unit and the second discharge unit have a same distance in a lengthwise direction, and the upper mounting part and the lower mounting part have a same distance in a lengthwise direction.

7. The indoor unit according to claim 2, wherein the first discharge unit and the second discharge unit have a same distance in a widthwise direction, and the upper mounting part and the lower mounting part have a same distance in a widthwise direction.

* * * * *